US005110122A

United States Patent [19]

Moore et al.

[11] Patent Number: 5,110,122

[45] Date of Patent: May 5, 1992

[54] EXERCISING APPARATUS AND METHOD

[75] Inventors: Christopher Moore; John C. Phillips, Jr., both of Pacoima, Calif.

[73] Assignee: Czeu Gathright, Los Angeles, Calif. ; a part interest

[21] Appl. No.: 581,979

[22] Filed: Sep. 14, 1990

[51] Int. Cl.[5] ..... A63B 21/00

[52] U.S. Cl. ..... 482/134; 482/138; 482/112; 482/123; 482/142

[58] Field of Search ..... 272/144, 130, 136, 138, 272/134, 116, 141, 94; 128/25 R

[56] References Cited

U.S. PATENT DOCUMENTS

| | | | |
|---|---|---|---|
| 2,152,431 | 3/1939 | Jenson | 128/25 R |
| 2,562,339 | 3/1949 | Socol | 272/144 |
| 2,598,204 | 1/1950 | Allen | 272/130 |
| 3,015,330 | 1/1962 | Linstrom | 128/25 R |
| 3,450,132 | 6/1969 | Ragon | 128/25 R |
| 3,674,017 | 7/1972 | Stefani | 128/25 R |
| 3,892,404 | 7/1975 | Martucci | 272/144 |
| 4,372,553 | 2/1983 | Hatfield | 272/136 |
| 4,478,413 | 10/1984 | Siwulu | 272/138 |
| 4,915,378 | 4/1990 | Abrahamian | 272/134 |

*Primary Examiner*—Robert Bahr
*Assistant Examiner*—Jerome Donnelly
*Attorney, Agent, or Firm*—Robert J. Schaap

[57] ABSTRACT

An exercising apparatus which is adapted for home use and is versatile to permit the performing of a large number of exercises with a single piece of equipment and which incorporates the exercise facilities offered by several conventional pieces of exercising equipment. The exercising apparatus comprises a seat section at one end with a back rest capable of being raised from a frame for supporting the lower back during various types of exercises including abdominal exercises. The seat back can be lowered in order to enable an individual to lay in a prone condition on the exercising apparatus in order to perform additional exercises such as abdominal exercises, arm exercises and the like. A method of exercising is also disclosed.

18 Claims, 3 Drawing Sheets

EXERCISING APPARATUS AND METHOD

BACKGROUND OF THE INVENTION

1. Field of the Invention

This relates in general to certain new and useful improvements in an exercising apparatus and more particularly, to an exercising apparatus which is small in size, light in weight and which enables performance of a large number of exercises previously available only with several pieces of conventional exercising equipment.

2. Brief Description of the Prior Art

In recent years, exercising and physical fitness have become popular with a large segment of the population in the United States. Many people belong to health spas and gyms and frequent these institutions for purposes of using the wide variety of exercising equipment available at these institutions.

There has also been a burgeoning home use market for exercising equipment. However, for home use equipment, it is necessary to have an exercising apparatus which is relatively small in size or which is capable of being folded to be relatively small in size for purposes of storage and transport and ease and convenience of use. Moreover, these conventional home use exercising apparatus must also be relatively light in weight for purposes of transport and positioning and yet they must be durable in order to enable performance of exercising thereon even by individuals with substantial weight and who use substantial force in performing exercises.

Most of the commercially available conventional exercising apparatus are very limited in the number of exercises which can be performed. As a simple example, one type of exercising equipment may be used only exclusively for a specific type of back exercise. Another type of equipment may be primarily, if not exclusively, adapted for use in performing leg exercises, etc. Even to the extent that some of the commercially available exercising apparatus can be used to perform more than one type of exercise, they are almost all limited to exercise of the same muscle or groups of muscles.

Heretofore, there has not been any truly effective home-use or commercial establishment exercising apparatus which is light in weight but which is quite durable and permits a wide variety of exercises to be performed thereon. The present invention thereby provides such a light in weight and yet highly durable and very effective exercising apparatus in which several differing exercises can be performed.

OBJECTS OF THE INVENTION

It is, therefore, one of the primary objects of the present invention to provide an exercising apparatus in which a large number of exercises for exercising different muscles and groups of muscles can be performed on a single piece of equipment.

It is another object of the present invention to provide an exercising apparatus of the type stated which is light in weight and durable in construction and which is also relatively small in size.

It is a further object of the present invention to provide an exercising apparatus of the type stated which includes a seat back section which can be raised from and lowered back into the plane of a frame of the exercising apparatus.

It is an additional object of the present invention to provide an exercising apparatus of the type stated which is effective in enabling a user to perform lower back exercises, abdominal exercises, arm exercises and leg exercises with a single piece of equipment.

With the above and other objects in view, our invention resides in the novel features of form, construction, arrangement and combination of parts presently described and pointed out in the claims.

BRIEF SUMMARY OF THE INVENTION

An exercising apparatus which is light in weight and portable and which enables a large number of exercises to be performed thereon. This exercising apparatus aids in the performance of certain exercises by applying variable resistive forces against movements of the person using the apparatus and also restrains movement of the body away from the exercising apparatus during the performance of certain exercises.

The exercising apparatus of the present invention comprises a frame having a pair of spaced apart frame bars lying in substantially the same horizontal plane. A seat supporting section is located on this frame in proximity to an end thereof for supporting the buttocks of a user. A head supporting section is also located on the frame and also lies in substantially the same horizontal plane as the seat supporting section.

The exercising apparatus of the present invention also comprises a back supporting section on the frame adjacent the seat supporting section and is capable of lying in substantially the same horizontal plane as the seat supporting section and the head supporting section. Thus, a user of the exercising apparatus can lie in a substantially prone position with his or her buttocks supported on the seat supporting section and the back, and particularly the lower back, supported on the back supporting section and the head supported on the head supporting section.

The exercising apparatus is provided with means to cause a raising of the back supporting section out of the horizontal plane so that it can assume somewhat of a vertical orientation and thereby provide certain support to the lower back in the performance of certain exercises. This positioning means also enables the back supporting section to be repositioned in the same horizontal plane as the seat supporting section and the head supporting section. In this way, a user of the apparatus can perform exercises while in the prone position.

In a more preferred embodiment, the positioning means is a variable resistance means against the back supporting section and against a force which is applied to the back supporting section tending to push the back supporting section into the same horizontal plane as the seat supporting section. The variable resistance means preferably comprises a dual resistance pistoncylinder arrangement. Thus, when a user attempts to push back against the back supporting section, a force will be applied to this back supporting section pushing against the force applied by the user.

The variable resistance means also provides a resistance against a force applied to the back supporting section which tends to pull the back supporting section out of the plane of the seat supporting section. In this way, when a user is restrained against or coupled to the back supporting section and attempts to pull the same out of the plane of the seat supporting section, a force is applied against the direction of pull such that there is a force tending to hold the back supporting section into the same horizontal plane as the seat supporting section against the force applied by the user.

The positioning means is constructed so that it can be secured to the back supporting section in any of a plurality of fixed positions. In this way, the user of the exercising apparatus can selectively control the amount of force which may be applied to the back supporting section. In like manner, the positioning means is completely detachable from the back supporting section to allow the latter to lay in the same horizontal plane as the seat supporting section and the head supporting section.

The exercising apparatus of the present invention also comprises a seat restraining member such as seat belts, for holding the buttocks against the seat supporting section. In like manner, this exercising apparatus also comprises a back restraining member associated with the back supporting section for holding a portion of the back of the user against the back supporting section. The back restraining member is preferably in the form of a shoulder harness.

The apparatus is provided with pulling means on the frame in the region of the back supporting section in proximity to the head supporting section to engage and pull during performance of abdominal exercises. The pulling means provides a variable resistive force against the force applied to the pulling means. In this case, the pulling means comprises straps for engaging and pulling when performing abdominal crunches and the straps are connected to springs.

The exercising apparatus also comprises additional pulling means located in the region of the head supporting section. This additional pulling means permits both arm exercises and back exercises. Furthermore, it is adjustable so that exercises may be performed on one lateral side only and then the exercises can be performed on the opposite lateral side.

This invention possesses many other advantages and has other purposes which may be made more clearly apparent from a consideration of the forms in which it may be embodied. These forms are shown in the drawings forming a part of and accompanying the present specification. They will now be described in detail for the purposes of illustrating the general principles of the invention, but it is to be understood that such detailed description is not to be taken in a limiting sense.

BRIEF DESCRIPTION OF THE DRAWINGS

Figure 1:
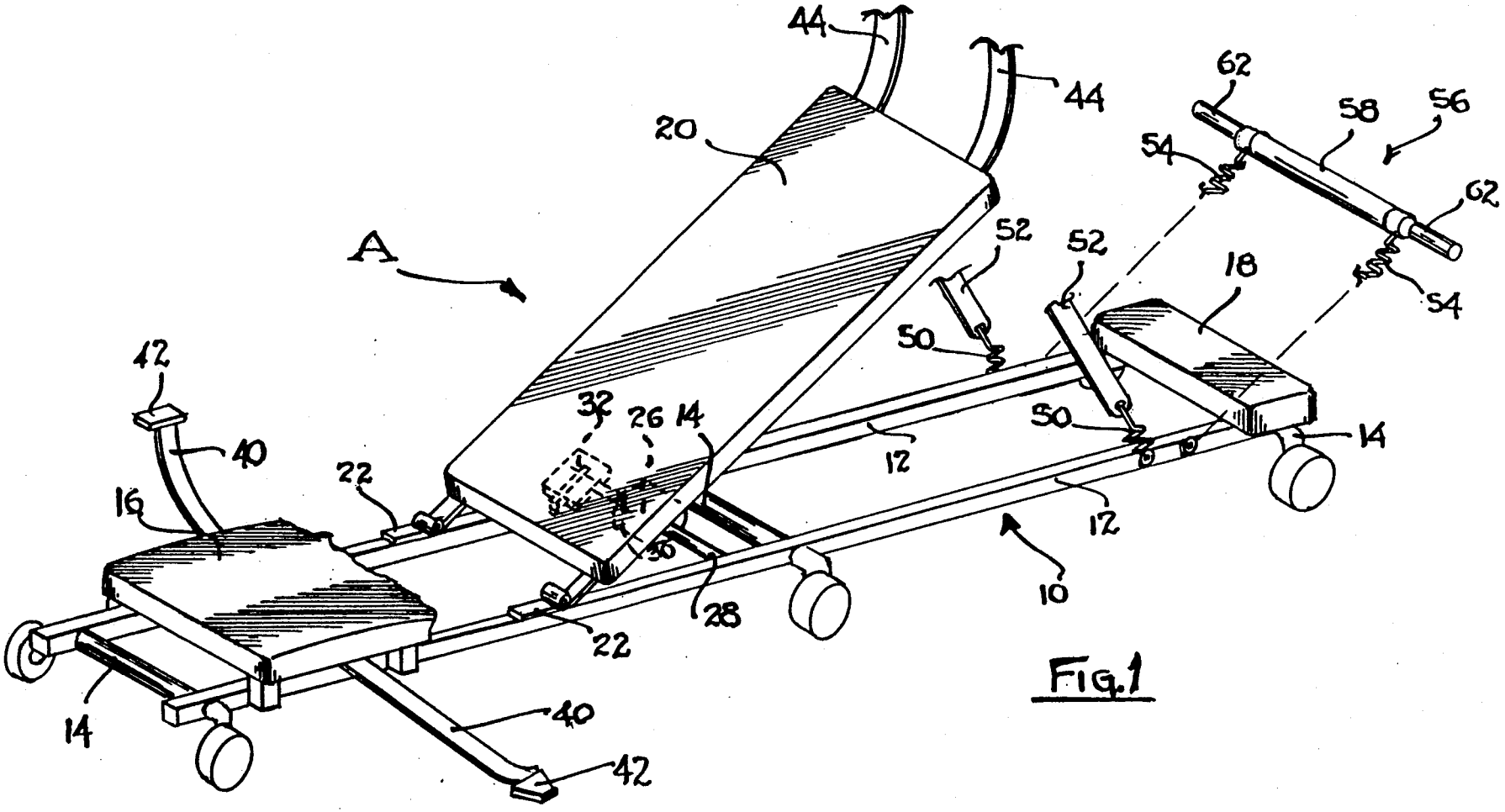
Figure 2:
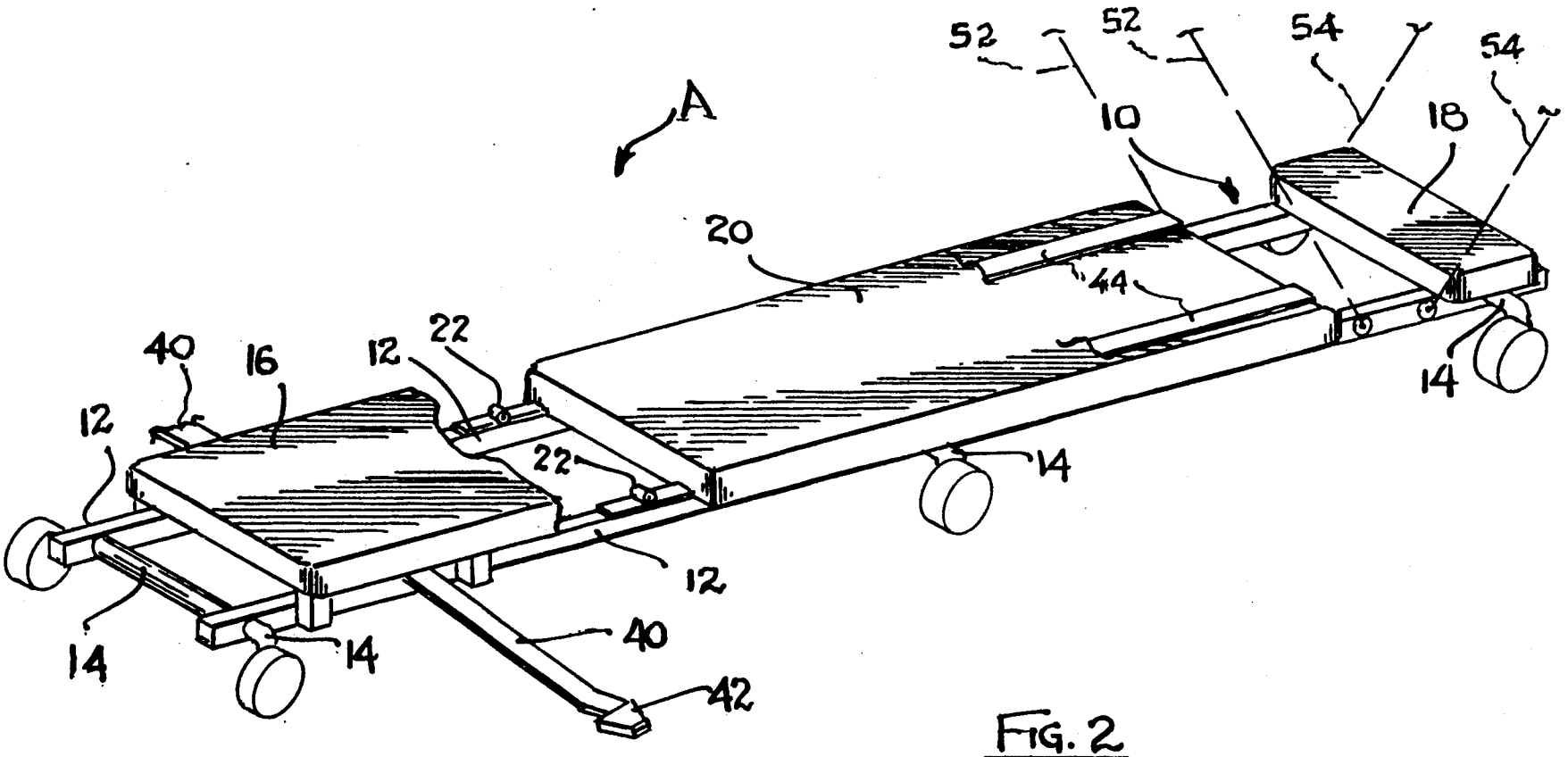
Figure 3:
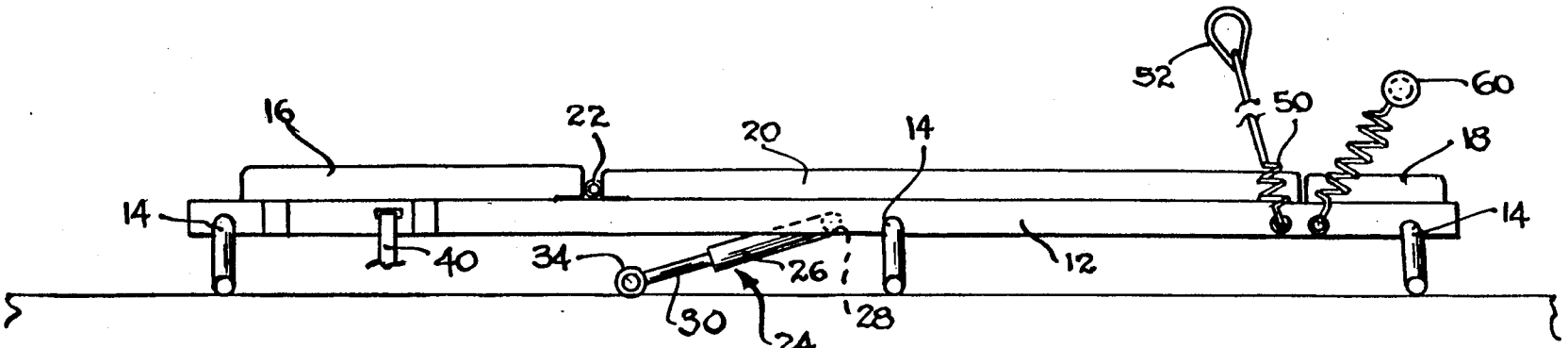
Figure 5:
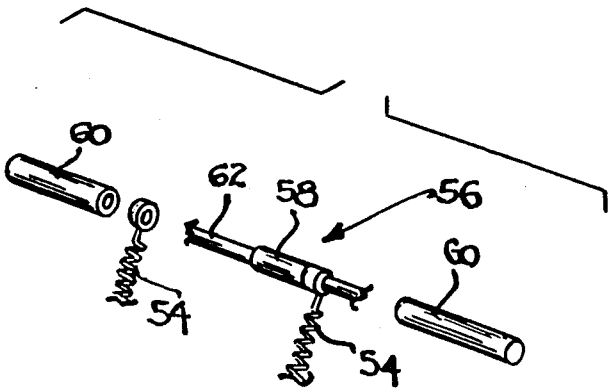
Figure 4:
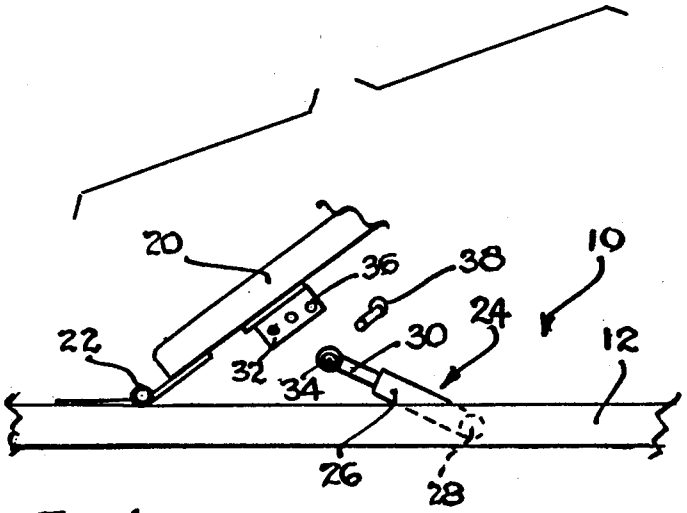

Having thus described the invention in general terms, reference will now be made to the accompanying drawings (three sheets) in which:

FIG. 1 is a perspective view of an exercising apparatus in which a back supporting section thereof is elevated to somewhat of an upright position and which is constructed in accordance with and embodies the present invention;

FIG. 2 is a perspective view of the exercising apparatus, similar to FIG. 1 and showing the back supporting section in substantially the same horizontal plane as head and seat supporting sections;

FIG. 3 is a side elevational view of the exercising apparatus of FIGS. 1 and 2;

FIG. 4 is a fragmentary side elevational view showing a mechanism for raising the back supporting section forming part of the exercising apparatus; and FIG. 5 is an exploded perspective view showing an additional pulling mechanism against which a user of the exercising apparatus may pull in the performance of exercises.

DETAILED DESCRIPTION OF A PREFERRED EMBODIMENT

Referring now in more detail and by reference characters to the drawings which illustrate a preferred embodiment of the present invention, A designates an exercising apparatus which enables the performance of a large number of exercises with a single piece of equipment. This exercising apparatus A is highly effective in the performance of abdominal and lower back exercises and provides resistive forces against forces applied by the body of the user.

The exercising apparatus A generally comprises a main frame 10 having a pair of longitudinally extending spaced apart frame bars 12. These frame bars 12 are connected at their forward and rearward ends and at intermediate their ends by means of transversely extending frame bars 14, as best illustrated in FIG. 3.

The frame 10 is provided with a seat supporting section 16 adjacent one end thereof. This seat supporting section 16 is adapted to receive and support the buttocks of a user of the exercising apparatus. Mounted at the opposite end of the frame 10 is a head supporting section 18 and which may be slightly elevated, if desired, in order to provide a slight elevation to the head of the user. Each of the seat supporting sections 16 and head supporting section 18 are fixedly secured to the frame and are not movable with respect thereto. For purposes of comfort, both the seat supporting section 16 and the head supporting section 18 are provided with a somewhat resilient cushioning material and outer covering.

Located intermediate the seat supporting section 16 and the head supporting section 18 is a back supporting section 20. The back supporting section 20 could be constructed in a manner similar to the other supporting sections with a somewhat resilient cushioning material and an outer layer.

By reference to FIG. 2, it can be observed that the back supporting section 20 can lie in substantially the same horizontal plane as the seat supporting section 16 and the head supporting section 18. Further, it is not necessary for the back supporting section 20 to abut against the seat supporting section 16 and the head supporting section 18, as long as the back supporting section 20 is somewhat adjacent the other two sections.

When in the position as illustrated in FIG. 2, it can be observed that a user of the exercising apparatus can lie in a prone position in order to perform certain exercises. Thus, the user could lie on his or her back or chest if desired. In this way, numerous exercises which are normally performed in a prone position can be performed with the exercising apparatus of the present invention.

The back supporting section 20 is hingedly connected to the frame bars 12 by a pair of hinged pins 22 as best illustrated in FIGS. 3 and 4 of the drawings. The back supporting section 20 is capable of being raised from a relatively prone position, as illustrated in FIG. 3, to a somewhat vertically oriented or upright position, as illustrated in FIG. 4, by means of a positioning mechanism or so-called "variable resistance mechanism" 24. This positioning mechanism 24 comprises a cylinder 26 which is pivotally secured to the opposed parallel frame bars 12 by means of a pivot pin 28. The cylinder 26 is provided with an extendable piston 30, as also best illustrated in FIGS. 3 and 4 of the drawings.

The underside of the back supporting section 20 is provided with a downwardly extending mounting plate 32 for securement to a fitting 34 on the end of the piston 30. Furthermore, the mounting plate 32 is provided with a plurality of apertures 36 for securement of the fitting 34 to any of these apertures. The fitting 34 preferably adopts the form of a pivot pin arrangement 38 which would be capable of extending into any of the selectively located apertures 36.

The piston-cylinder arrangement, as illustrated, is a "bi-directional" piston-cylinder arrangement such that it provides a resistance when there is a force tending to pull the piston 30 out of the cylinder 26 and it provides a like and opposite resistance when there is a force rending to push the piston 30 back into the cylinder 26. This bi-directional piston-cylinder arrangement is often referred to as a dual acting piston-cylinder arrangement or a dual acting resistance means inasmuch as it provides a resistance when both a pulling force and a pushing force is applied to the piston.

When it is desired to cause the back supporting section 20 to remain in a prone position, the piston 30 is disconnected from the plate 32 and is allowed to pivot downwardly so that it can rest against the floor or other supporting surface. Further, a means to support the free end of the piston could be provided, if desired. When it is desired to raise the back supporting section, the piston is pivotally connected to one of the apertures 36 in the plate 32. The back supporting section can then assume a somewhat upright or raised position, as shown in FIG. 1 of the drawings.

The exercising apparatus of the present invention is provided with seat restraining means, preferably in the form of a seat belt 40, and which is secured to the frame 10 as illustrated. This seat belt 40 is provided with releasable buckles 42 for connecting the two seat belt sections together to thereby restrain the buttocks of a user against the seat supporting section 16. The back supporting section 20 is also provided with a back restraining means in the form of a shoulder harness 44. This shoulder harness 44 may adopt the form of two individual shoulder belts mounted on the frame 10 and which extend over the shoulder of a user and which can be secured and buckled.

When the user of the apparatus is securely restrained against the seat supporting section 16 and the back supporting section 20, the user can perform various abdominal and lower back exercises. When the user attempts to perform exercises in the nature of sit-ups, he or she will effectively pull the back supporting section 20 to somewhat of a upright position. However, the dual-acting resistance piston-cylinder arrangement 24 will pull against the force applied by the user. When the user of the apparatus attempts to push against the back supporting section 20 to force the same horizontal plane as the seat supporting section 16, the dual-acting piston-cylinder arrangement will also cause a force tending to oppose that of the user of the apparatus. The user of the apparatus can selectively control the amount of force which he or she is required to use by selectively positioning the piston in any one of the apertures 36.

The exercising apparatus of the present invention is highly effective in the performance of sit-up exercises. Normally, sit-up exercises are performed on a floor or other hard surface and can be hazardous to the spinal column of the body. Furthermore, the exercising apparatus enables the performance of sit-up exercises without the necessity of securing the user's feet under a supporting structure and which is often a necessity for many parties. Further, inasmuch as the back and particularly the lower back is always supported against the back supporting section, the possibility of lower back injuries during the performance of exercises are reduced.

Mounted on the frame 10 in proximity to the upper portion of the back supporting section 20 are a pair of springs 50 and secured to the outer ends of the springs 50 are hand engaging straps 52. The straps 52 may be provided with hand engaging loops at their outer ends, if desired. These straps are effective for pulling when performing abdominal crunch exercises. The abdominal crunches are typically performed when laying in a flat prone condition on the exercising apparatus.

A pair of additional springs 54 are also secured to the frame 10, as best illustrated in FIGS. 1 and 2 of the drawings and connected to the outer end of each of the springs 54 on the opposite side of the frame is a handle 56. The handle 56 can be engaged by a user of the apparatus while in a prone condition for raising and lowering against the force of the springs 54. The handle 56 can be removed from the springs in the manner as best illustrated in FIG. 5.

The handle 56 is provided with a handle bar 58 and a pair of hand grip sections 60. The handle bar 58 is also provided with rods 62 to extend into loops at the outer end of the springs 54. Thus, with this construction, it is possible to completely remove the handle 56 from the springs 54 or completely removing the hand grips 60 and then remove the rods 62 from the loops at the end of the springs 54. Furthermore, it is possible to remove only one hand grip and leave the other one intact. In this latter arrangement, it is possible to perform lateral flexure exercises of the back. This type of exercising enables lateral pulling against the springs and will also aid in strengthening the gluteal muscles.

Thus, there has been illustrated and described a unique and novel exercising apparatus which enables the performance of a large number of exercises with a single piece of equipment and also a method for performing exercises. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention.

Having thus described the invention, what I desire to claim and secure by letters patent is:

1. An exercising apparatus which is light in weight and portable and which enables a large number of exercises to be performed thereon, said exercising apparatus comprising:

a) a frame comprised of a pair of spaced apart frame bars lying in substantially the same horizontal plane;

b) a seat supporting section on said frame in proximity to an end thereof for supporting the buttocks of a user;

c) a back supporting section on said frame adjacent said seat supporting section and capable of lying in substantially the same horizontal plane as the seat supporting section;

d) a head supporting section on said frame adjacent said back supporting section and also lying in substantially the same horizontal plane as the seat supporting section;

e) bi-directional resistance means which has no positive driving force to permit a raising of the back supporting section out of the same horizontal plane so that it can assume a somewhat vertical orientation for providing certain support to the lower back in the performance of certain exercises, said bi-directional resistance means also enabling the back supporting section to be re-positioned in the same horizontal plane as the seat supporting section and head supporting section to enable a user to perform other exercises when in a prone position, f) means associated with said bi-directional resistance means to provide a resistive force against said back supporting section which operates in opposition to a pushing force applied to an opposite side of the back supporting section by a user leaning against the back supporting section and which pushing force tends to push the back supporting section into the same horizontal plane as the seat supporting section, said bi-directional resistance means also providing a resistive force operating against and in opposition to a pulling force applied to the back supporting section when a user attempts to pull the back supporting section out of the plane of the seat supporting section, and g) means for removably coupling the back of the user to the back supporting section to cause the back supporting section to move only with the back of the user.

2. The exercising apparatus of claim 1 further characterized in that connecting means is operatively connected to said bi-directional resistance means to enable the resistance means to be connected to the back supporting section at any of a plurality of selected positions to allow the back supporting section to achieve a selected angular position with respect to the seat supporting section.

3. The exercising apparatus of claim 2 further characterized in that said seat supporting section is connected to one end of said frame.

4. The exercising apparatus of claim 1 further characterized in that pulling means is provided on said frame in the region of the back supporting section in proximity to the head supporting section to engage said pull during performance of abdominal exercises.

5. The exercising apparatus of claim 4 further characterized in that the pulling means provides a variable resistive force against the force applied to pull the pulling means.

6. The exercising apparatus of claim 5 further characterized in that additional pulling means is provided on said frame in the region of said head supporting means to engage and pull or push and which also provides a variable resistive force.

7. The exercising apparatus of claim 2 further characterized in that said bi-directional resistance means comprises a dual acting resistance piston-cylinder arrangement.

8. The exercising apparatus of claim 7 further characterized in that said connecting means is connected to said bidirectional resistance means to be adjustably positionable between said frame and back supporting section at a plurality of fixed positions and so that said resistance means can be completely disconnected between said frame and back supporting section.

9. The exercising apparatus of claim 2 further characterized in that seat restraining means is associated with said seat supporting section for holding the buttocks of the user against the seat supporting section, and the means for coupling to back of the user is a back restraining means for holding the back of the user against the back supporting section.

10. The exercising apparatus of claim 9 further characterized in that the seat restraining means comprises a seat belt and the back restraining means comprises a shoulder harness.

11. An exercising apparatus which is light in weight and portable and which enables a large number of exercises to be performed thereon, said exercising apparatus comprising:

a) a frame comprised of a pair of spaced apart frame bars lying in substantially the same horizontal plane, b) a seat supporting section on said frame in proximity to and end thereof for supporting the buttocks of a user, c) a back supporting section on said frame adjacent said seat supporting section and capable of lying in substantially the same horizontal plane as the seat supporting section, d) a head supporting section on said frame adjacent said back supporting section and also lying in substantially the same horizontal plane as the seat supporting section, e) hinge means at one end of said back supporting section enabling said back supporting section to be hingedly movable out of the plane of the seat supporting section so as to be angularly position with respect thereto, f) bi-directional resistance means, which has no positive driving force connected to said back supporting section, to provide a resistive force against said back supporting section which operates in opposition to a pushing force applied to the back supporting section by a user leaning against the back supporting section and which pushing force tends to push the back supporting section into the same horizontal plane as the seat supporting section, said bi-directional resistance means also providing a resistive force operating against and in opposition to a pulling force applied to the back supporting section when a user attempts to pull the back supporting section out of the plane of the seat supporting section, and g) means for removably coupling the back of the user to the back supporting section to cause the back supporting section to move only with the back of the user.

12. The exercising apparatus of claim 11 furtehr characterized in that the bi-directional resistance means comprises a dual acting resistive piston-cylinder arrangement.

13. The exercising apparatus of claim 11 further characterized in that seat restraining means is associated with said seat supporting section for holding the buttocks against the seat supporting section, and the means for coupling the back of a user is a back restraining means for holding of the back of the user against the back supporting section.

14. The exercising apparatus of claim 13 further characterized in that pulling means is provided on said frame in the region of the back supporting section in proximity to the head supporting section to engage and pull during performance of abdominal exercises.

15. The exercising apparatus of claim 14 further characterized in that the pulling means provides a variable resistive force against the force applied to pull the pulling means.

16. The exercising apparatus of claim 11 further characterized in that said exercising apparatus comprises:

a) bi-directional resistance means causes a raising of the back supporting section out of the same horizontal plane so that it can assume a somewhat vertical orientation for providing certain support to the lower back in the performance of certain exercises, said dual acting resistance means also enabling the back supporting section to be re-positioned in the same horizontal plane as the seat supporting section and head supporting section to enable a user to perform other exercises when in a prone position, and b) means associated with said dual acting resistance means to enable the back supporting section to be located in any of a plurality of fixed positions with respect to the seat supporting section.

17. A method of enabling the performance of a plurality of exercises with a single apparatus and applying various forces against which the body may work in the performance of such exercises, said method comprising:

a) sitting on a seat of the apparatus during performance of abdominal exercises and lower back exercises and which apparatus has a back supporting section capable of lying in substantially the same plane as the seat and being raised out of that plane to a position where it can assume somewhat of a vertical orientation;

b) removably coupling the back of the user to the back supporting section so that the back supporting section can only move with the back of the user;

c) pushing against a back supporting member tending to force same downwardly by a user positioning his or her back against the back supporting member and which pushing force from a user is in opposition to a force applied to the back supporting member tending to force the same upwardly against the force applied by the user, and where the force in opposition to the force applied by the user is supplied by a bi-directional resistance means which has no positive driving force and which force supplied by the resistance means can be variable depending on the force applied by the user; and d) pulling against the back supporting member by a user having his or her back juxtaposed to the back supporting member and pulling the same upwardly, and where the pulling force applied by the user is in opposition to a force applied to the back supporting member tending to force the same downwardly, and where the force tending to force the back supporting member downwardly in opposition to the force applied by the user is supplied by the bi-directional resistance means and can also be variable depending on the amount of force applied by the user.

18. The method of claim 17 further characterized in that said method comprises restraining the buttocks of a user against a seat supporting member to which the back supporting member is physically and hingedly connected.

* * * * *